US010410512B1

(12) United States Patent
Chu

(10) Patent No.: US 10,410,512 B1
(45) Date of Patent: Sep. 10, 2019

(54) SWITCH FOR OUTPUTTING ADJUSTMENT SIGNAL BY INTERRUPTION LINEAR SIGNAL

(71) Applicant: Ching-Hsiung Chu, New Taipei (TW)

(72) Inventor: Ching-Hsiung Chu, New Taipei (TW)

(73) Assignee: Ching-Hsiung Chu, New Taipei (TW)

( * ) Notice: Subject to any disclaimer, the term of this patent is extended or adjusted under 35 U.S.C. 154(b) by 0 days.

(21) Appl. No.: 16/205,285

(22) Filed: Nov. 30, 2018

(30) Foreign Application Priority Data

Nov. 1, 2018 (TW) ..... 107138791 A

(51) Int. Cl.
*G09F 25/00* (2006.01)
*G08C 19/06* (2006.01)

(52) U.S. Cl.
CPC ..... *G08C 19/06* (2013.01)

(58) Field of Classification Search
CPC ..... B60W 10/00; F16H 1/00
See application file for complete search history.

(56) References Cited

U.S. PATENT DOCUMENTS

2010/0044130 A1* 2/2010 Froeschl ..... B60K 6/20 180/65.25
2010/0126295 A1* 5/2010 Akkerman ..... F16H 59/042 74/473.36

* cited by examiner

*Primary Examiner* — Shirley Lu

(57) ABSTRACT

The present invention provides a switch for outputting adjustment signal by interruption linear signal, comprising: a base; a moving element, one part of the moving element extending outside of the base; a gear set, which is rotated by moving the moving element and has an output gear; an interruption gear, rotated in a clockwise direction or an anticlockwise direction by driving the output gear, wherein the interruption gear has a plurality of interruption teeth distributed on periphery of the interruption gear; and at least one linear signal transceiver including an emission end and a reception end, wherein the emission end and reception end are respectively set two sides of the interruption teeth, when the interruption gear is rotated, signal delivery between the emission end and reception end is optionally interrupted by the interruption teeth, and a signal is emitted when the emission end and reception end are interrupted.

4 Claims, 3 Drawing Sheets

SWITCH FOR OUTPUTTING ADJUSTMENT SIGNAL BY INTERRUPTION LINEAR SIGNAL

FIELD OF INVENTION

The present invention relates to a switch for outputting an adjustment signal by interruption a linear signal. In particular, it relates to a switch for outputting amplifying signal or diminishing signal respectfully depending on operating in bidirection.

BACKGROUND OF THE INVENTION

In various types of electronic products, there are many control button switches for producing signal to perform turn-on and control function. There are also many different types, sizes, and standards of switches in wide application.

Toggle switch is one of switches and common in the market. It has functions of amplifying signal or diminishing signal respectfully in bidirection, also has a pole or a block to control zoom-in or zoom-out, moving forward or moving backward, increasing pressure or reducing pressure, and so on. The magnetic force changes when the pole moves, thereby generating electromagnetic induction. The intensity can be determined by the change of electric power generated by electromagnetic induction.

However, in this type of switch, the magnetic force is determined by moving the pole or block. Therefore, the stronger or weaker magnetic force compared with the pole in the last position is obtained when moving the pole. However, this switch can not provide precise control effect by segment, so as to not be applied in precise control.

In addition, the control effect generated by electromagnetic induction may be influenced or interfered by other magnetic force. When this switch is interfered by other magnetic force, the control effect is almost impossible to be precise. This is another disadvantage.

To sum up, the inventor designed a switch for outputting an adjustment signal by interruption a linear signal to improve aforementioned disadvantages and enhance industrial application.

The above information disclosed in this section is only for enhancement of understanding of the background of the described technology and therefore it may contain information that does not form the prior art that is already known to a person of ordinary skill in the art.

SUMMARY OF THE INVENTION

In order to improve the disadvantages of conventional technology, the present invention provides a switch for outputting adjustment signal by interruption linear signal having novelty and non-obviousness, and expects to overcome the downside of conventional technology.

In order to achieve the aforementioned purpose, the present invention provides a switch for outputting adjustment signal by interruption linear signal, comprising: a base, wherein the base is a housing; a moving element, set within the base, one part of the moving element extending outside of the base, and moved within a limited distance in bidirection; a gear set, set within the base and connected with the moving element, wherein the gear set is rotated by moving the moving element, and the gear set has an output gear, which is able to be rotated in a clockwise direction or an anticlockwise direction by moving the moving element in bidirection; an interruption gear, set within the base and rotated in a clockwise direction or an anticlockwise direction by driving the output gear, wherein the interruption gear has a plurality of interruption teeth, and each of the interruption tooth is set apart from each other and distributed on periphery of the interruption gear; and at least one linear signal transceiver, set within the base, wherein the linear signal transceiver comprises an emission end and a reception end, and the emission end and the reception end are respectively set two sides of the interruption teeth, when interruption gear is rotated, signal delivery between the emission end and the reception end is optionally interrupted by the interruption teeth, and a signal is emitted when the emission end and the reception end are interrupted.

In the embodiment of the present invention, the quantity of linear signal transceiver is two and set apart from each other, one of the linear signal transceiver is interrupted firstly when the interruption gear is rotated in clockwise direction, and another linear signal transceiver is consequently interrupted, when the interruption gear is rotated in anticlockwise direction, an order of interrupting the linear signal transceiver is reversed; a movement direction of the moving element is able to be determined by the order of interrupting the linear signal transceiver, the linear signal transceiver is connected with a control circuit, and the control circuit is capable of emitting amplifying signal or diminishing signal depending on the movement direction of the moving element.

In the embodiment of the present invention, the moving element is a pole for movement in bidirection.

In the embodiment of the present invention, the moving element is a block for horizontal movement in bidirection.

A switch for outputting adjustment signal by interruption linear signal of the present invention provides a moving element, such as a pole or block, which moves in bidirection, and controls signal for amplifying or diminishing depending on its movement direction. This technology and mechanism can adjust, such as, brightness, volume, power, zoom-in or zoom-out, temperature, and so on. The segment control can be determined by setting the plurality of interruption teeth 41, and the adjustment for amplifying or diminishing signal can be quantified. This is not obvious for conventional technology and can be used in precision control.

Many of the attendant features and advantages of the present invention will become better understood with reference to the following detailed description considered in connection with the accompanying drawings.

BRIEF DESCRIPTION OF THE DRAWINGS

The detailed structure, operating principle and effects of the present invention will now be described in more details hereinafter with reference to the accompanying drawings that show various embodiments of the present invention as follows.

DETAILED DESCRIPTION OF THE PREFERRED EMBODIMENTS

Figure 1:
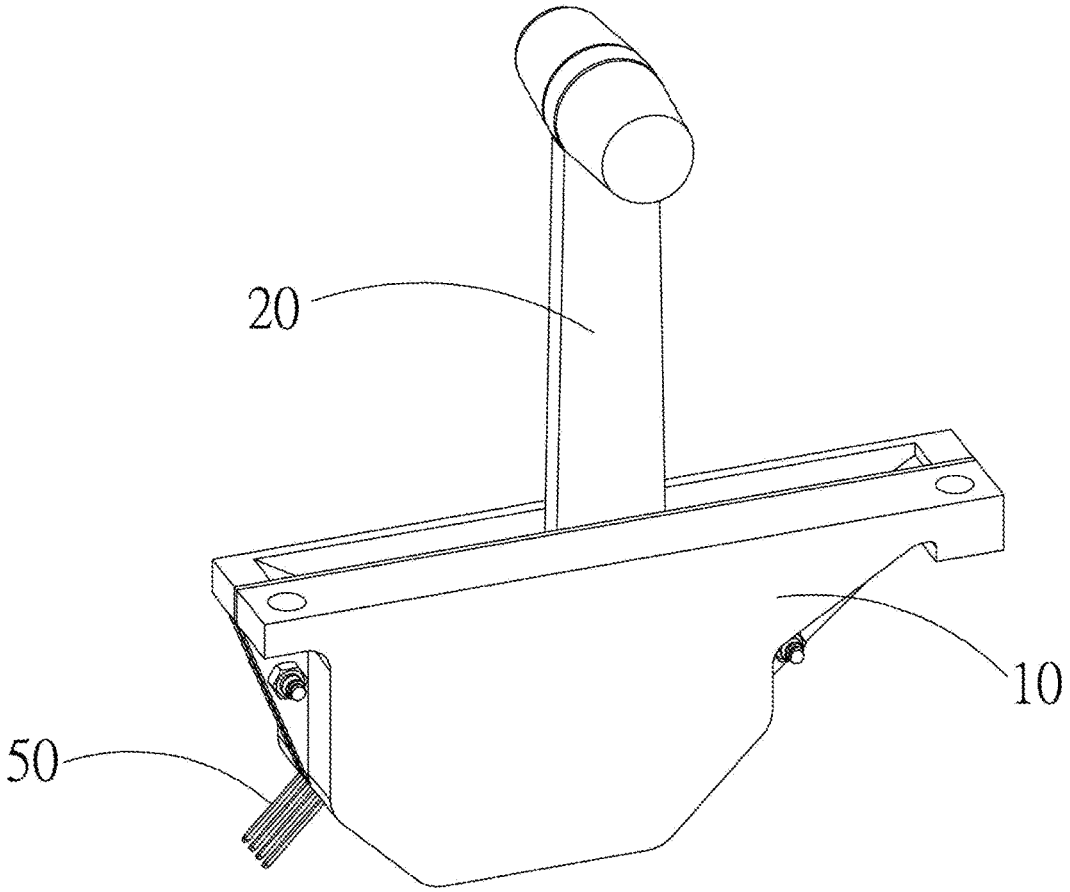
FIG. 1 is a schematic diagram of a switch for outputting adjustment signal by interruption linear signal in the present invention.

Reference will now be made in detail to the exemplary embodiments of the present invention, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this invention will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way.

For convenience, certain terms employed in the specification, examples and appended claims are collected here. Unless defined otherwise, all technical and scientific terms used herein have the same meaning as commonly understood by one of the ordinary skill in the art to which this invention belongs.

Various embodiments will now be described more fully with reference to the accompanying drawings, in which illustrative embodiments are shown. The inventive concept, however, may be embodied in various different forms, and should not be construed as being limited only to the illustrated embodiments. Rather, these embodiments are provided as examples, to convey the inventive concept to one skilled in the art. Accordingly, known processes, elements, and techniques are not described with respect to some of the embodiments.

The singular forms "a", "and", and "the" are used herein to include plural referents unless the context clearly dictates otherwise.

Figure 2:
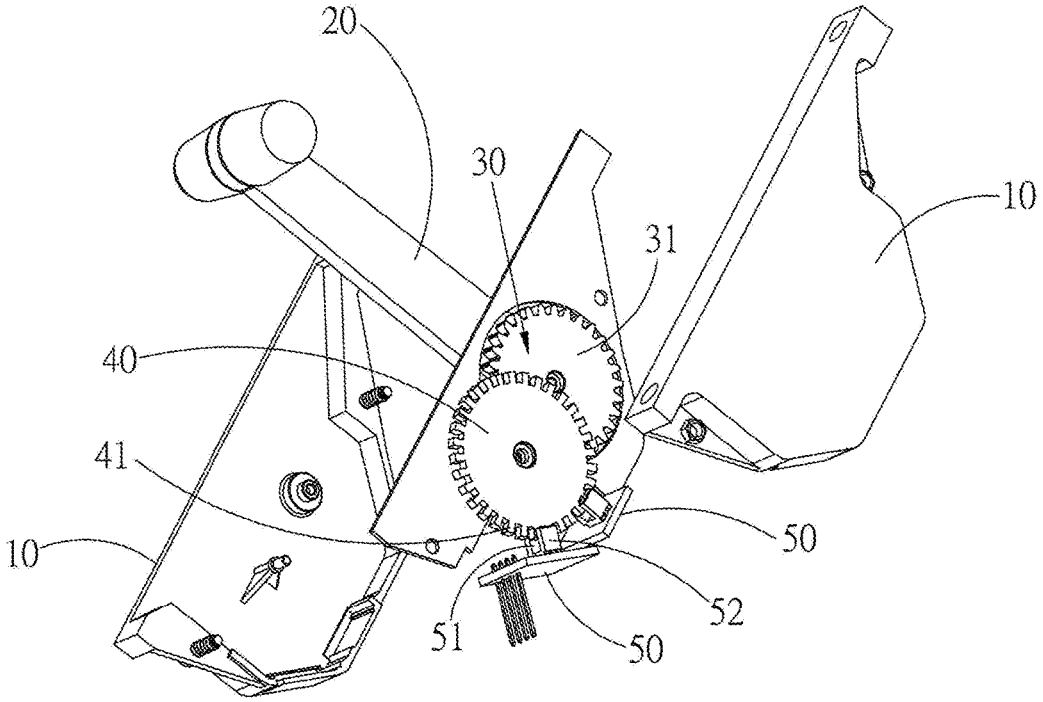
FIG. 2 is an exploded diagram of a switch for outputting adjustment signal by interruption linear signal in the present invention.
Figure 3:
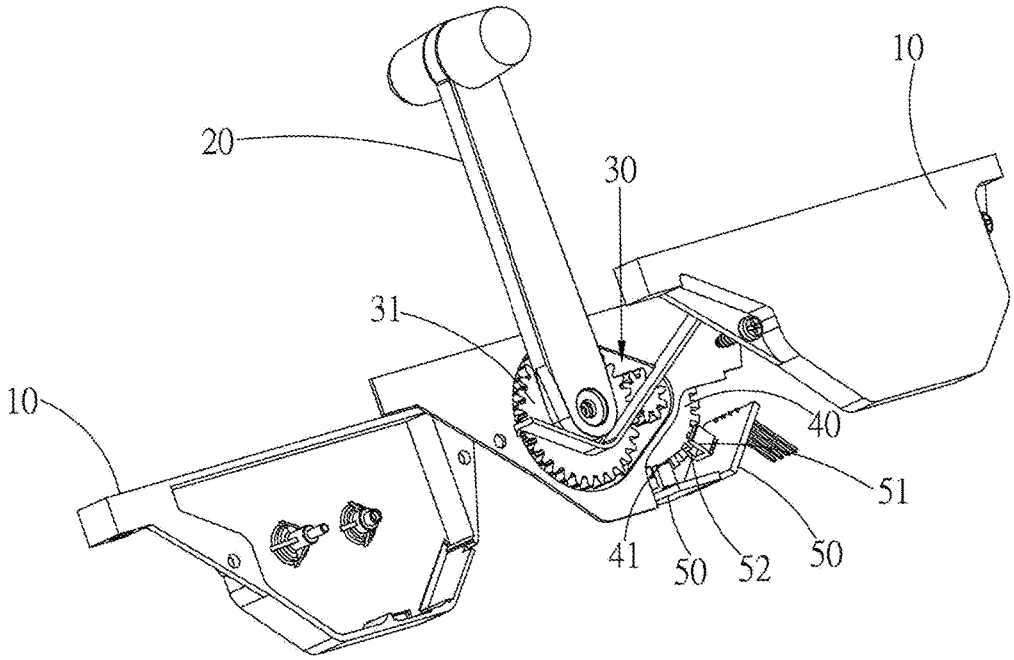
FIG. 3 is an exploded diagram in another viewing angle of a switch for outputting adjustment signal by interruption linear signal in the present invention.

Please refer to FIGS. 1~3, the present invention provides a switch for outputting adjustment signal by interruption linear signal, comprising a base 10, a moving element 20, a gear set 30, an interruption gear 40, and two linear signal transceivers 50.

The base 10 is a housing, and an inside of the base 10 is an assembling space.

The moving element 20 corresponds to the assembling space of the base 10, and one part of the moving element 20 extends outside of the base 10. Please refer to FIG. 1, the moving element 20 can be a pole moving within a limited distance in bidirection, and other elements which can be moving in bidirection can be employed in this embodiment.

The gear set 30 is set within the assembling space of the base 10, and is connected with the moving element 20. The gear set 30 is rotated by moving the moving element 20. The gear set 30 has an output gear 31, which can be rotated in a clockwise direction or an anticlockwise direction by moving the moving element 20 in bidirection. The gear set 30 has a variable speed (transmission) function. The output gear 31 corresponding to the moving element 20 can do faster rotation or slower rotation. The gear transmission mechanism is a conventional technology and is known for the person having skills in the art. Therefore, this part is not deeply explained in this embodiment.

The interruption gear 40 is set within the assembling space of the base 10, and is rotated in a clockwise direction or an anticlockwise direction by driving the output gear 31. The interruption gear 40 has a plurality of interruption teeth 41, and each of them is set apart from each other and distributed on the periphery of the interruption gear 40.

The two linear signal transceivers 50 is set within the assembling space of the base 10, and correspond to the interruption teeth 41 of the interruption gear 40. The two linear signal transceivers 50 comprise an emission end 51 and a reception end 52, and the emission end 51 and reception end 52 are respectively set two sides of the interruption teeth 41. When interruption gear 40 is rotated, signal delivery between the emission end 51 and reception end 52 is interrupted by the interruption teeth 41, and a signal is emitted when the emission end 51 and reception end 52 are interrupted. In another aspect of the embodiment, the signal is emitted when the emission end 51 and reception end 52 are not interrupted.

When the interruption gear 40 is rotated, one of the two linear signal transceivers 50 is interrupted firstly by the interruption teeth 41 of the interruption gear 40. Also, another linear signal transceiver 50 is consequently interrupted by that. If interruption gear 40 is rotated in clockwise direction, the linear signal transceiver 50 on the right side is interrupted earlier than that on the left side. On the contrary, if interruption gear 40 is rotated in anticlockwise direction, the linear signal transceiver 50 on the left side is interrupted earlier than that on the right side. As a result, according to the order of interrupting the linear signal transceiver 50, the signal emitted from the two linear signal transceivers 50 is in order. From that, the movement direction of the moving element 20 can be determined so as to make sure the determination mechanism of control signal including amplifying signal or diminishing signal. Furthermore, the two linear signal transceivers 50 are able to be connected with a control circuit, and the control circuit is capable of emitting amplifying signal or diminishing signal depending on the movement direction of the moving element 20.

In addition, determination of the movement direction of the moving element 20 or the rotation direction of the interruption gear 40 can be replaced by other technology. Therefore, when application of the present invention, only one linear signal transceiver 50 can be used with a device which can determine the movement direction of the moving element 20. This method can also achieve the same effect. This technology is also known for the person having ordinary skills in the art, so that the detailed description is not further explained in this embodiment.

A switch for outputting adjustment signal by interruption linear signal of the present invention provides a moving element, such as a pole or block, which moves in bidirection and controls signal for amplifying or diminishing depending on its movement direction. This technology and mechanism can adjust, such as, brightness, volume, power, zoom-in or zoom-out, temperature, and so on. The segment control can be determined by setting the plurality of interruption teeth 41, and the adjustment for amplifying or diminishing signal can be quantified. This is not obvious for conventional technology and can be used in precision control.

It will be understood that the above description of embodiments is given by way of example only and that various modifications may be made by those with ordinary skill in the art. The above specification, examples, and data provide a complete description of the present invention and use of exemplary embodiments of the invention. Although various embodiments of the invention have been described above with a certain degree of particularity, or with reference to one or more individual embodiments, those with ordinary skill in the art could make numerous alterations or modifications to the disclosed embodiments without departing from the spirit or scope of this invention.

What is claimed is:

1. A switch for outputting adjustment signal by interruption linear signal, comprising:

a base, wherein the base is a housing;

a moving element, set within the base, one part of the moving element extending outside of the base, and moved within a limited distance in bidirection;

a gear set, set within the base and connected with the moving element, wherein the gear set is rotated by moving the moving element, and the gear set has an output gear, which is able to be rotated in a clockwise direction or an anticlockwise direction by moving the moving element in bidirection;

an interruption gear, set within the base and rotated in a clockwise direction or an anticlockwise direction by driving the output gear, wherein the interruption gear has a plurality of interruption teeth, and each of the interruption tooth is set apart from each other and distributed on periphery of the interruption gear; and at least one linear signal transceiver, set within the base, wherein the linear signal transceiver comprises an emission end and a reception end, and the emission end and the reception end are respectively set two sides of the interruption teeth, when the interruption gear is rotated, signal delivery between the emission end and the reception end is optionally interrupted by the interruption teeth, and a signal is emitted when the emission end and the reception end are interrupted.

2. The switch as defined in claim 1, wherein the quantity of linear signal transceiver is two and set apart from each other, one of the linear signal transceiver is interrupted firstly when the interruption gear is rotated in clockwise direction, and another linear signal transceiver is consequently interrupted, when the interruption gear is rotated in anticlockwise direction, an order of interrupting the linear signal transceiver is reversed; a movement direction of the moving element is able to be determined by the order of interrupting the linear signal transceiver, the linear signal transceiver is connected with a control circuit, and the control circuit is capable of emitting amplifying signal or diminishing signal depending on the movement direction of the moving element.

3. The switch as defined in claim 1, wherein the moving element is a pole for movement in bidirection.

4. The switch as defined in claim 1, wherein the moving element is a block for horizontal movement in bidirection.

* * * * *